US010850519B2

(12) United States Patent
Miyazawa

(10) Patent No.: US 10,850,519 B2
(45) Date of Patent: Dec. 1, 2020

(54) LIQUID EJECTING HEAD AND LIQUID EJECTING APPARATUS

(71) Applicant: SEIKO EPSON CORPORATION, Tokyo (JP)

(72) Inventor: Ikuya Miyazawa, Yamagata-Mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/582,531

(22) Filed: Sep. 25, 2019

(65) Prior Publication Data

US 2020/0094558 A1 Mar. 26, 2020

(30) Foreign Application Priority Data

Sep. 26, 2018 (JP) ..... 2018-179825
Feb. 22, 2019 (JP) ..... 2019-030393

(51) Int. Cl.

| | |
|---|---|
| ***B41J 2/16*** | (2006.01) |
| ***B41J 2/155*** | (2006.01) |
| ***B41J 2/14*** | (2006.01) |
| ***B41J 2/055*** | (2006.01) |

(52) U.S. Cl.

CPC ..... *B41J 2/1623* (2013.01); *B41J 2/055* (2013.01); *B41J 2/14201* (2013.01); *B41J 2/155* (2013.01); *B41J 2/161* (2013.01); *B41J 2002/14241* (2013.01)

(58) Field of Classification Search

CPC ..... B41J 2/1623; B41J 2002/14491
See application file for complete search history.

(56) References Cited

U.S. PATENT DOCUMENTS

| | | | | |
|---|---|---|---|---|
| 6,619,785 | B1 * | 9/2003 | Sato | B41J 2/14274 347/50 |
| 2016/0276571 | A1 | 9/2016 | Tanaka | |
| 2019/0092013 | A1 * | 3/2019 | Mizuno | B41J 2/14233 |
| 2019/0291487 | A1 * | 9/2019 | Tanaka | B41J 2/14201 |

FOREIGN PATENT DOCUMENTS

| | | |
|---|---|---|
| JP | 2016-168807 | 9/2016 |

* cited by examiner

*Primary Examiner* — Sharon Polk
(74) *Attorney, Agent, or Firm* — Workman Nydegger

(57) ABSTRACT

A liquid ejecting head including a first substrate in which a drive element that ejects a liquid from a nozzle, and a first wire electrically coupled to the drive element are formed, a second substrate in which an opposing surface that opposes the first substrate is adhered to the first substrate with an adhesive agent, a second wire being formed in the second substrate, and a protrusion configured to elastically deform, the protrusion being formed between the first substrate and the second substrate and electrically coupling the first wire and the second wire to each other. In the liquid ejecting head, a swelling ratio of the protrusion is larger than a swelling ratio of the adhesive agent.

5 Claims, 7 Drawing Sheets

LIQUID EJECTING HEAD AND LIQUID EJECTING APPARATUS

The present application is based on, and claims priority from JP Application Serial Number 2018-179825, filed Sep. 26, 2018 and JP Application Serial Number 2019-030393, filed Feb. 22, 2019, the disclosures of which are hereby incorporated by reference in their entirety.

BACKGROUND

1. Technical Field

The present disclosure relates to a liquid ejecting head and a liquid ejecting apparatus.

2. Related Art

Hitherto, a liquid ejecting head that ejects a liquid, such as ink, from a plurality of nozzles has been proposed. For example, JP-A-2016-168807 discloses an ink jet recording head that includes piezoelectric elements that eject a liquid from nozzles, and a sealing plate that supplies a drive signal to the piezoelectric elements. A substrate in which the piezoelectric elements are formed and the sealing plate are bonded to each other with an adhesive agent, and bump electrodes formed on the sealing plate and lower electrodes of the piezoelectric elements are in communication with each other.

With the technique in JP-A-2016-168807, when the adhesive agent and the bump electrodes absorbing moisture become expanded, the sealing plate and the substrate become distanced away from each other. Accordingly, electrical coupling between the bump electrodes and the lower electrodes cannot be obtained sufficiently.

SUMMARY

In order to overcome the above issue, a liquid ejecting head according to a desirable aspect of the present disclosure includes a first substrate in which a drive element that ejects a liquid from a nozzle, and a first wire electrically coupled to the drive element are formed, a second substrate in which an opposing surface that opposes the first substrate is adhered to the first substrate with an adhesive agent, a second wire being formed in the second substrate, and a protrusion configured to elastically deform, the protrusion being formed between the first substrate and the second substrate and electrically coupling the first wire and the second wire to each other. In the liquid ejecting head, a swelling ratio of the protrusion is larger than a swelling ratio of the adhesive agent.

DESCRIPTION OF EXEMPLARY EMBODIMENTS

First Embodiment

Figure 1:
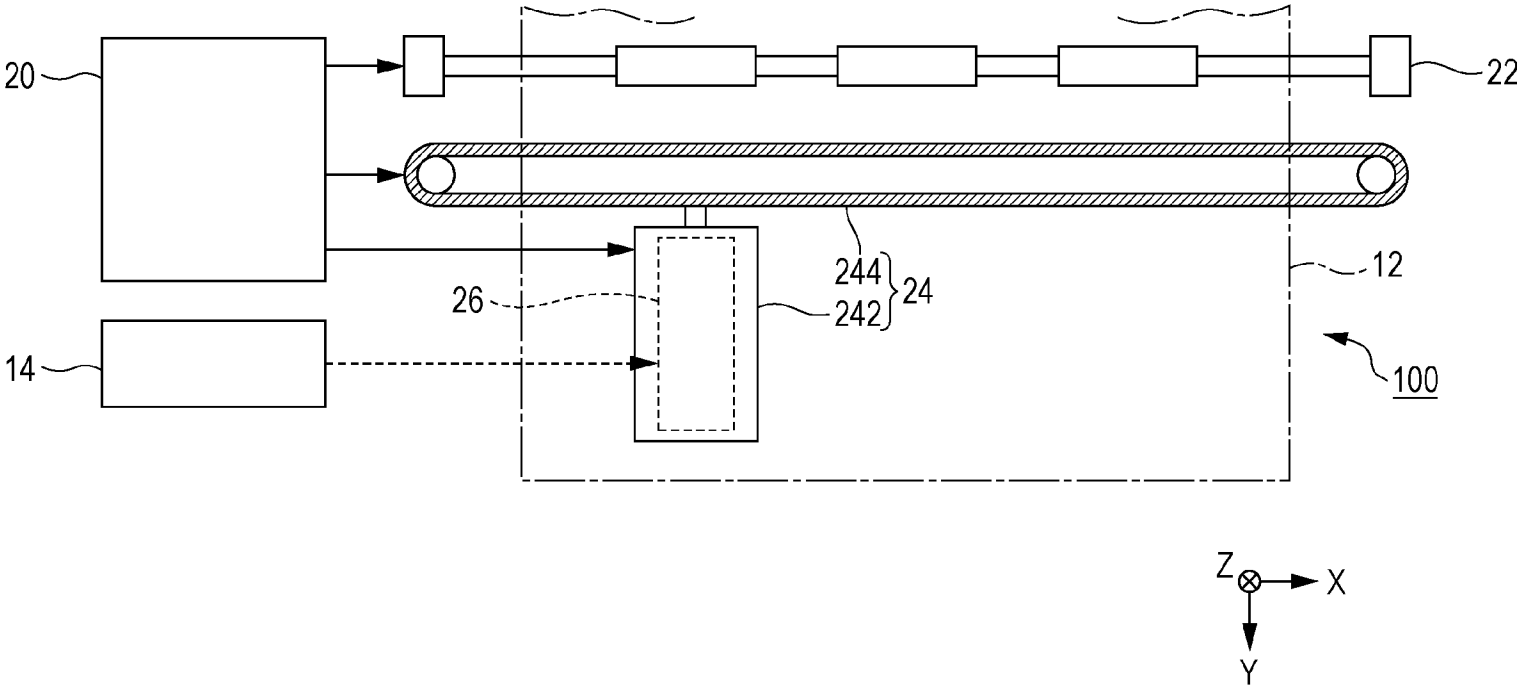
FIG. 1 is a block diagram illustrating a configuration of a liquid ejecting apparatus according to a first embodiment of the present disclosure.

FIG. 1 is a block diagram illustrating an example of a liquid ejecting apparatus 100 according to a first embodiment. The liquid ejecting apparatus 100 of the first embodiment is an ink jet printing apparatus that ejects ink, which is an example of a liquid, on a medium 12. While the medium 12 is typically printing paper, an object to be printed formed of any material, such as a resin film or fabric, is used as the medium 12. As illustrated as an example in FIG. 1, a liquid container 14 that stores ink is installed in the liquid ejecting apparatus 100. For example, a cartridge configured to detach from the liquid ejecting apparatus 100, a bag-shaped ink pack formed of flexible film, or an ink tank into which ink can be refilled is used as the liquid container 14. A plurality of types of inks of different colors are stored in the liquid container 14.

As illustrated as an example in FIG. 1, the liquid ejecting apparatus 100 includes a control unit 20, a transport mechanism 22, a moving mechanism 24, and a liquid ejecting head 26. The control unit 20 includes a processing circuit such as a central processing unit (CPU) or a field programmable gate array (FPGA) and a memory circuit such as a semiconductor memory, and controls each element of the liquid ejecting apparatus 100 in an integrated manner. The transport mechanism 22 transports the medium 12 in a Y direction under the control of the control unit 20.

The moving mechanism 24 reciprocates the liquid ejecting head 26 in an X direction under the control of the control unit 20. The X direction is a direction that intersects the Y direction in which the medium 12 is transported. The moving mechanism 24 of the first embodiment includes a substantially box-shaped transport body 242 that houses the liquid ejecting head 26 and a transport belt 244 to which the transport body 242 is fixed. Note that a configuration in which a plurality of liquid ejecting heads 26 are mounted in the transport body 242 or a configuration in which the liquid container 14 is mounted in the transport body 242 together with the liquid ejecting head 26 can be adopted.

The liquid ejecting head 26 ejects ink, which is supplied from the liquid container 14, to the medium 12 through a plurality of nozzles under the control of the control unit 20. Concurrently with the transportation of the medium 12 performed with the transport mechanism 22 and the repetitive reciprocation of the transport body 242, the liquid ejecting head 26 ejects ink onto the medium 12 to form a desired image on a surface of the medium 12. Note that a direction perpendicular to an XY plane is hereinafter referred to as a Z direction. The direction in which the ink is ejected by the liquid ejecting head 26 corresponds to the Z direction. The XY plane is, for example, a plane parallel to the surface of the medium 12.

Figure 2:
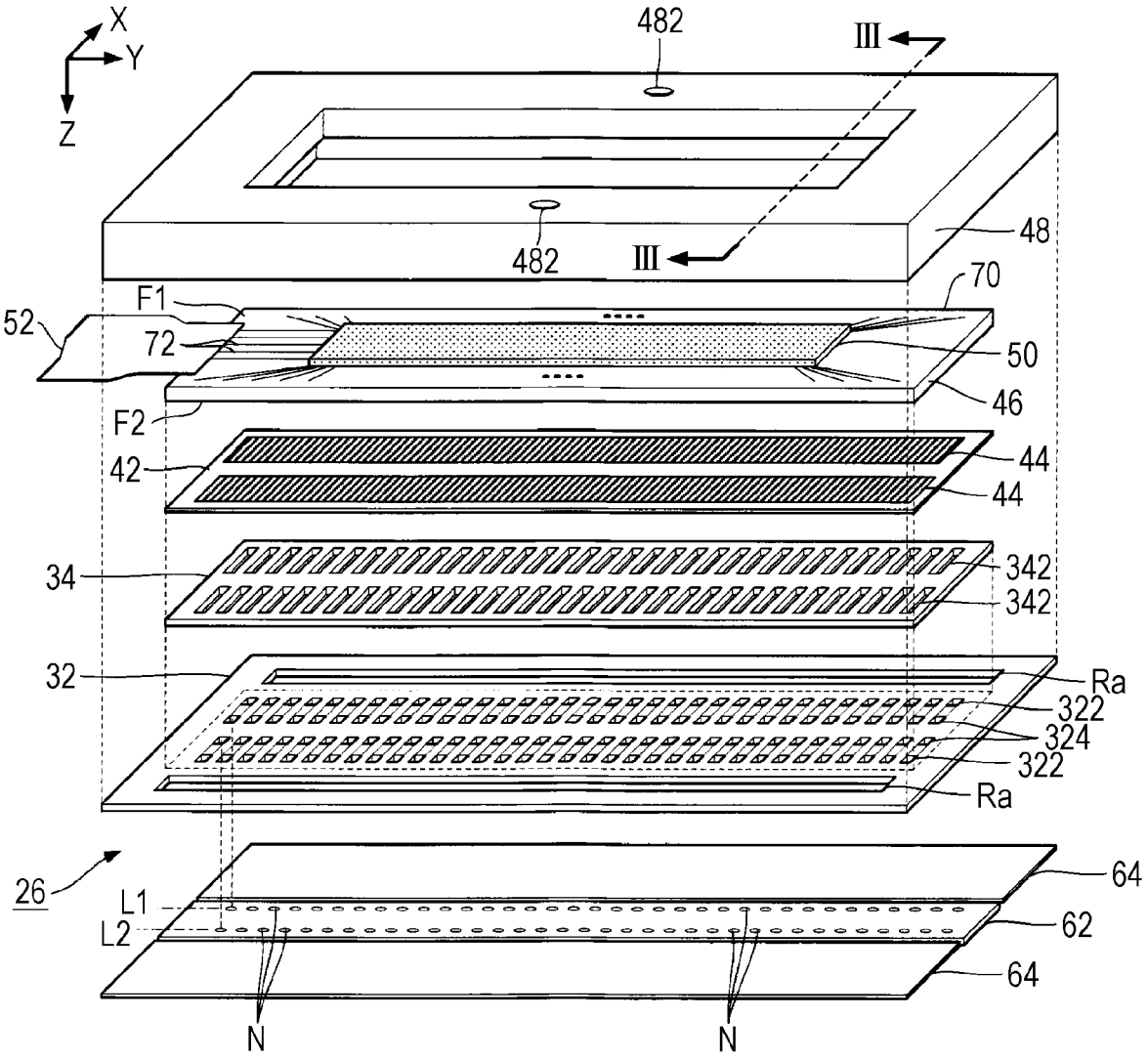
FIG. 2 is a block diagram illustrating a functional configuration of the liquid ejecting apparatus.
Figure 3:
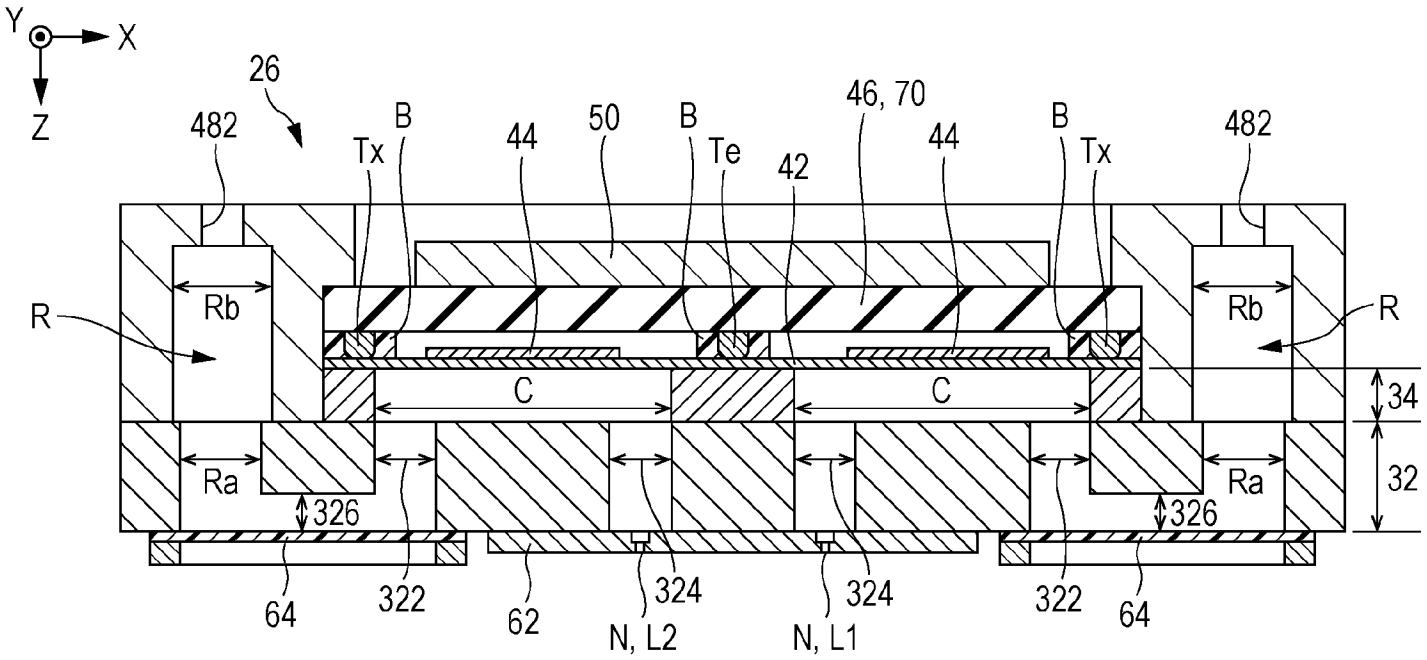
FIG. 3 is a cross-sectional view taken along line III-III in FIG. 2.

FIG. 2 is an exploded perspective view of the liquid ejecting head 26, and FIG. 3 is a cross-sectional view taken along line III-III in FIG. 2. As illustrated as an example in FIG. 2, the liquid ejecting head 26 includes a plurality of nozzles N arranged in the Y direction. The plurality of nozzles N of the first embodiment are divided into a first line L1 and a second line L2 that are parallelly arranged with a space in between in the X direction. The first line L1 and the second line L2 are each a set of a plurality of nozzles N linearly arranged in the Y direction. Note that while the positions of the nozzles N of the first line L1 and those of the second line L2 in the Y direction can be different from each other, for the sake of convenience, a configuration in which the positions of the nozzles N of the first line L1 and those of the second line L2 in the Y direction are set to coincide each other is described below as an example. As it can be understood from FIG. 3, the liquid ejecting head 26 of the first embodiment is structured so that the elements related to each of the nozzles N in the first line L1 and the elements related to each of the nozzles N in the second line L2 are disposed in a substantially axisymmetric manner.

As illustrated as an example in FIGS. 2 and 3, the liquid ejecting head 26 includes a flow path substrate 32. As illustrated as an example in FIG. 2, a pressure chamber substrate 34, a diaphragm 42, a wiring substrate 46, a housing portion 48, and a drive circuit 50 are provided on the negative side of the flow path substrate 32 in the Z direction. The diaphragm 42 is an example of a first substrate. On the other hand, a nozzle plate 62 and a vibration absorber 64 are provided on the positive side of the flow path substrate 32 in the Z direction. Generally, each element of the liquid ejecting head 26 is a plate-shaped member elongated in the Y direction and is connected to each other using an adhesive agent, for example.

The nozzle plate 62 is a plate-shaped member in which a plurality of nozzles N are formed, and is provided on a surface of the flow path substrate 32 on the positive side in the Z direction. Each of the plurality of nozzles N is a circular through hole through which ink passes. In the nozzle plate 62 of the first embodiment, the plurality of nozzles N constituting the first line L1 and the plurality of nozzles N constituting the second line L2 are formed. The nozzle plate 62 is manufactured by processing a single crystal substrate formed of silicon (Si) using a semiconductor manufacturing technique such as, for example, dry etching or wet etching. However, any known materials and any known manufacturing methods can be adopted to manufacture the nozzle plate 62.

As illustrated as an example in FIGS. 2 and 3, in the flow path substrate 32, a space Ra, a plurality of supply flow paths 322, a plurality of communication flow paths 324, and a supply liquid chamber 326 are formed for each of the first line L1 and the second line L2. Each space Ra is, in plan view in the Z direction, an elongated opening formed in the Y direction, and the supply flow paths 322 and the communication flow paths 324 are each through holes formed for a corresponding nozzle N. Each supply liquid chamber 326 is an elongated space formed in the Y direction and across a plurality of nozzles N, and communicates the space Ra and the plurality of supply flow paths 322 to each other. Each of the plurality of communication flow paths 324 overlaps a corresponding single nozzle N in plan view.

As illustrated as an example in FIGS. 2 and 3, the pressure chamber substrate 34 is a plate-shaped member in which a plurality of pressure chambers C are formed in each of the first line L1 and the second line L2. The plurality of pressure chambers C are arranged in the Y direction. Each pressure chamber C is formed for each nozzle N and is a space elongated in the X direction in plan view. Similar to the nozzle plate 62 described above, the flow path substrate 32 and the pressure chamber substrate 34 are manufactured by processing a single crystal substrate formed of silicon using a semiconductor manufacturing technique, for example. However, any known materials and any known manufacturing methods can be adopted to manufacture the flow path substrate 32 and the pressure chamber substrate 34.

As illustrated as an example in FIG. 2, the diaphragm 42 is formed on a surface of the pressure chamber substrate 34 opposite the flow path substrate 32. The diaphragm 42 of the first embodiment is a plate-shaped member configured to vibrate elastically. Note that portions or the entire diaphragm 42 can be formed so as to be integrated with the pressure chamber substrate 34 by selectively removing the plate-shaped member, having a predetermined plate thickness, at portions corresponding to the pressure chambers C in the plate thickness direction.

As understood from FIG. 2, the pressure chambers C are spaces located between the flow path substrate 32 and the diaphragm 42. A plurality of pressure chambers C are arranged in the Y direction in each of the first line L1 and the second line L2. As illustrated in FIGS. 2 and 3, the pressure chambers C are in communication with the communication flow paths 324 and the supply flow paths 322. Accordingly, the pressure chambers C are in communication with the nozzles N through the communication flow paths 324 and are in communication with the spaces Ra through the supply flow paths 322 and the supply liquid chamber 326.

As illustrated as an example in FIGS. 2 and 3, the liquid ejecting head 26 of the first embodiment includes a plurality of piezoelectric elements 44 corresponding to different nozzles, and a drive circuit 50 that drives each of the plurality of piezoelectric elements 44. The drive circuit 50 outputs a drive signal to each of the piezoelectric elements 44. The drive signal is a voltage signal for driving the piezoelectric element 44. The plurality of piezoelectric elements 44 each corresponding to different nozzles N are formed for each of the first line L1 and the second line L2 and on a surface of the diaphragm 42 on a side opposite the pressure chambers C. Each piezoelectric element 44 is a drive element that ejects ink form the nozzle N by changing the pressure inside the pressure chamber C. Specifically, each piezoelectric element 44 is an actuator that becomes deformed by having drive signals supplied thereto, and is elongated in the X direction in plan view. The plurality of piezoelectric elements 44 are arranged in the Y direction so as to correspond to the plurality of pressure chambers C. When the diaphragm 42 working together with the deformation of the piezoelectric elements 44 vibrates, the pressures inside the pressure chambers C change and the ink filled in the pressure chambers C is ejected through the communication flow paths 324 and the nozzles N.

Figure 4:
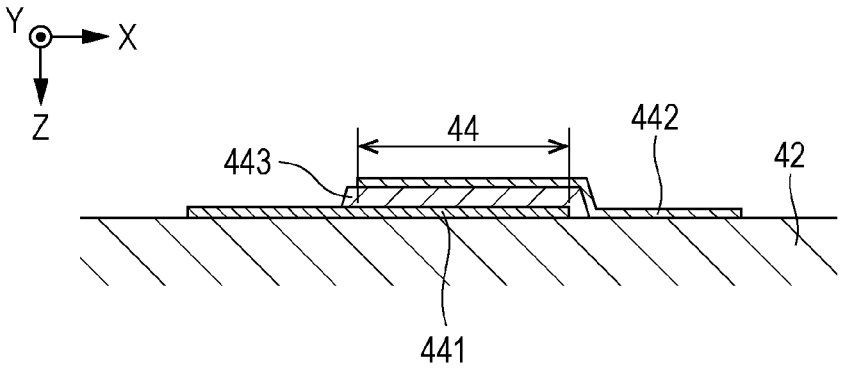
FIG. 4 is a cross-sectional view illustrating a configuration of a piezoelectric element.

FIG. 4 is a cross-sectional view illustrating a configuration of the piezoelectric element 44. As illustrated as an example in FIG. 4, the piezoelectric element 44 is a layered body in which a piezoelectric layer 443 is interposed between a first electrode 441 and a second electrode 442 that oppose each other. The first electrode 441 is formed on the surface of the diaphragm 42, and is an individual electrode formed for the piezoelectric element 44. On the other hand, the second electrode 442 is a common electrode continuous across a plurality of piezoelectric elements 44. Portions in which the first electrode 441, the second electrode 442, and the piezoelectric layer 443 overlap each other in plan view function as the piezoelectric element 44. When the diaphragm 42 working together with the deformation of the piezoelectric elements 44 vibrates, the pressure of the ink inside the pressure chambers C changes and the ink filled in the pressure chambers C is ejected to portions external to the pressure chambers C through the communication flow paths 324 and the nozzles N. Note that a configuration in which the first electrode 441 is a common electrode for the piezoelectric elements 44, and the second electrode 442 is an individual electrode, or a configuration in which both the first electrode 441 and the second electrode 442 are individual electrodes can be adopted.

The wiring substrate 46 in FIG. 2 is a plate-shaped member opposing the surface of the diaphragm 42, on which the plurality of piezoelectric elements 44 are formed, with a gap in between. The wiring substrate 46 of the first embodiment also functions as a reinforcing plate that reinforces the mechanical strength of the liquid ejecting head 26 and a sealing plate that protects and seals the piezoelectric elements 44. As illustrated as an example in FIG. 2, the wiring substrate 46 is electrically coupled to the control unit 20 through an external wiring 52. The external wiring 52 is a flexible wiring substrate that supplies various voltages and drive signals from the control unit 20 to the wiring substrate 46. A connecting component such as a flexible printed circuit (FPC) or a flexible flat cable (FFC) is suitably employed as the external wiring 52, for example.

The housing portion 48 is a case for storing the ink supplied to the plurality of pressure chambers C. As illustrated as an example in FIG. 3, in the housing portion 48 of the first embodiment, a space Rb is formed in each of the first line L1 and the second line L2. Each space Rb of the housing portion 48 and the corresponding space Ra of the flow path substrate 32 communicate with each other. The spaces configured by the space Ra and the space Rb function as liquid storage chambers R that store the ink supplied to the plurality of pressure chambers C. Ink is supplied to the liquid storage chambers R through the introduction openings 482 formed in the housing portion 48. The ink in the liquid storage chambers R is supplied to the pressure chambers C through the supply liquid chambers 326 and the supply flow paths 322. The vibration absorber 64 is a flexible film constituting wall surfaces of the liquid storage chambers R and absorbs the pressure fluctuations of the ink inside the liquid storage chambers R.

The wiring substrate 46 includes a base portion 70 and a plurality of wires 72. The base portion 70 is an example of a second substrate. The base portion 70 is an insulating plate-shaped member elongated in the Y direction, and is located between the diaphragm 42 and the drive circuit 50. The base portion 70 is manufactured by processing a single crystal substrate formed of silicon using a semiconductor manufacturing technique, for example. However, any known materials and any known manufacturing methods can be adopted to manufacture the base portion 70.

As illustrated as an example in FIG. 2, the base portion 70 includes a first surface F1 and a second surface F2 positioned opposite each other. The second surface F2 opposes the diaphragm 42. The second surface F2 is an example of an opposing surface. Specifically, the base portion 70 is installed so that the second surface F2 opposes the surface of the diaphragm 42 with an interval in between. As illustrated as an example in FIG. 2, the drive circuit 50 and the external wiring 52 are mounted on the first surface F1 of the base portion 70. The drive circuit 50 is an IC chip elongated in a longitudinal direction of the base portion 70. The external wiring 52 is mounted at an end portion of the first surface F1 of the base portion 70 on the negative side in the Y direction. A plurality of wires 72 that transmit a reference voltage and a drive signal supplied from the control unit 20 through the external wiring 52 are formed in the first surface F1 and the second surface F2 of the base portion 70.

As illustrated as an example in FIG. 3, connecting terminals Tx and a connecting terminals Te are formed between the diaphragm 42 and the base portion 70. In the first embodiment, the connecting terminals Tx and the connecting terminals Te are formed on the second surface F2 of the base portion 70. The wires 72 formed on the second surface F2 are an example of second wires. The wires 72 are electrically coupled to an output terminal of the drive circuit 50 via through electrodes formed in the wiring substrate 46. The connecting terminal Tx is formed for each piezoelectric element 44. The wires 72 that transmit the drive signal are electrically coupled to the first electrodes 441 of the piezoelectric elements 44 through the connecting terminals Tx. Accordingly, the drive signal is supplied to each first electrode 441 that is an individual electrode. On the other hand, the wires 72 that transmit the reference voltage are electrically coupled to the second electrode 442 of the piezoelectric elements 44 through the connecting terminals Te. Accordingly, the reference voltage is supplied to the second electrode 442 that is a common electrode. Note that the number of connecting terminals Te may be any number.

Figure 5:
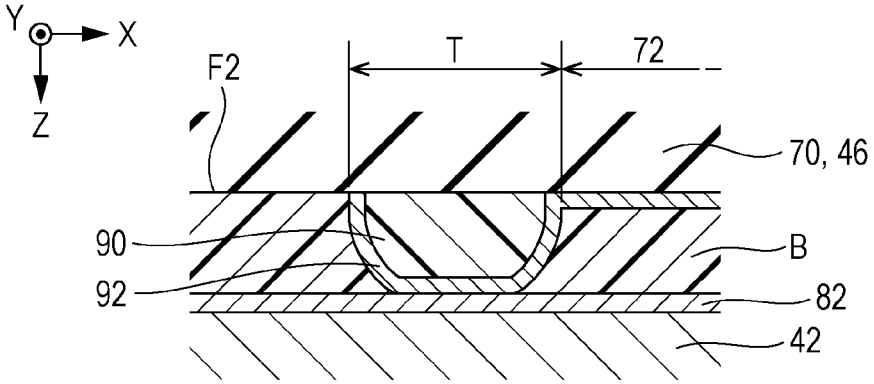
FIG. 5 is a cross-sectional view of a diaphragm and a wiring substrate in a vicinity of a connecting terminal.
Figure 6:
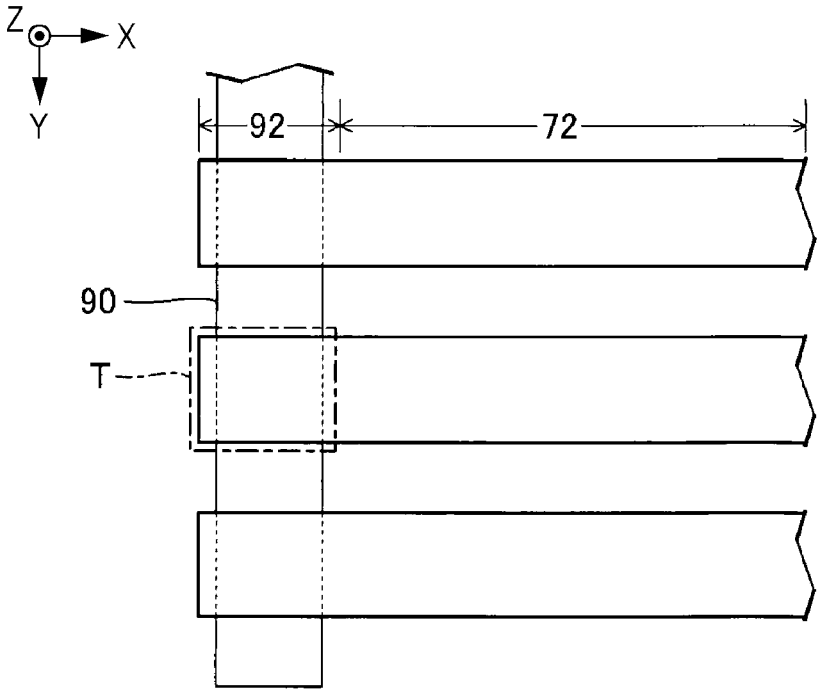
FIG. 6 is a plan view of connecting terminals.

Hereinafter, when there is no need to make a distinction between the connecting terminals Tx and the connecting terminals Te, the connecting terminals will be referred to as "connecting terminals T". FIG. 5 is a cross-sectional view of the diaphragm 42 and the wiring substrate 46 in the vicinity of the connecting terminal T, and FIG. 6 is a plan view of the connecting terminals T. As illustrated as an example in FIG. 5, the connecting terminal T is formed on the second surface F2 of the base portion 70 in the wiring substrate 46. The connecting terminal T of the first embodiment includes an elastic body 90 and a conductive film 92. The elastic body 90 is formed of, for example, a resin material so as to protrude from the second surface F2. For example, a product named "AH-3000" provided by HITACHI CHEMICAL CO., LTD. is used to form the elastic body 90. The elastic body 90 of the first embodiment is formed of an insulating material. The cross-sectional shape of the elastic body 90 is a semicircle, for example. As illustrated as an example in FIG. 6, the elastic body 90 is formed across a plurality of wires 72 so as to extend in the Y direction. As illustrated as an example in FIG. 5, the conductive film 92 is formed of a conductive material covering the elastic body 90. As illustrated as an example in FIG. 6, the conductive film 92 continuous to the wires 72 is formed on the surface of the elastic body 90. The wires 72 and the conductive film 92 are formed in the same layer with a known film forming technique such as, for example, sputtering. First end portions of the wires 72 are connected to the conductive film 92, and second end portions thereof are electrically coupled to the drive circuit 50 through the through electrodes of the wiring substrate 46. The connecting terminal T functions as an elastically deformable protrusion. Note that the elastic body 90 may be formed individually for each wire 72.

As illustrated as an example in FIG. 5, a wire 82 electrically coupled to the piezoelectric element 44 is formed on the diaphragm 42. Specifically, a plurality of wires 82 that are each electrically coupled to a corresponding wire 72 through the corresponding connecting terminal T are formed on the diaphragm 42. The wires 82 are an example of first wires. The wires 82 coupled to the connecting terminals Tx are connected to the first electrodes 441 of the piezoelectric elements 44. The first electrodes 441 and the wires 82 connected to the first electrodes 441 are, for example, formed in the same layer. On the other hand, the wires 82 coupled to the connecting terminals Te are connected to the second electrode 442 of the piezoelectric elements 44. The second electrode 442 and the wires 82 connected to the second electrode 442 are, for example, formed in the same layer. As illustrated in FIG. 5, a portion in the vicinity of the top of the connecting terminal T is in contact with the surface of the wire 82. In other words, each connecting terminal T is formed to overlap the corresponding wire 82 in plan view. Each connecting terminal T comes in contact with the corresponding wire 82 while in an elastically deformed state. In other words, pressing force is exerted form either one of the diaphragm 42 and the connecting terminal T to the other one of the diaphragm 42 and the connecting terminal T. As understood from the description above, the wires 72 and the wires 82 are electrically coupled through the connecting terminals T.

As illustrated as an example in FIG. 3, the diaphragm 42 and the wiring substrate 46 are fixed to each other using an adhesive agent B. Specifically, the second surface F2 of the base portion 70 in the wiring substrate 46 and the diaphragm 42 are adhered to each other with the adhesive agent B. For example, a product named "TMMR (registered trademark)" provided by TOKYO OHKA KOGYO CO., LTD. is used as the adhesive agent B. The adhesive agent B is applied between the wiring substrate 46 and the diaphragm 42 so as not to contact the piezoelectric elements 44. Specifically, the adhesive agent B is applied to the surroundings of the connecting terminals T. As illustrated as an example in FIG. 5, in the first embodiment, the connecting terminal T is in contact with the adhesive agent B. For example, in a state in which the adhesive agent B is applied so as to be in contact with the surfaces of the connecting terminals T in the base portion 70, the base portion 70 and the diaphragm 42 are bonded to each other with the connecting terminals T urged against the surfaces of the wires 82. However, the adhesive agent B is not interposed between the connecting terminals and the wires 82.

Hereinafter, a swelling ratio of the connecting terminal T and a swelling ratio of the adhesive agent B will be described. Swelling is a phenomenon in which a substance is expanded by absorbing moisture, and the swelling ratio is a ratio of the volume after the swelling to the volume before the swelling. In other words, the larger the swelling ratio, the larger the increase in the volume due to the swelling. The moisture absorbed by the connecting terminals T and the adhesive agent B is, for example, moisture that exists in the atmosphere of the use environment or moisture attributed to ink. Compared with an elastic member, the conductive film 92 has a sufficiently small film thickness and swelling due to absorbing moisture barely occurs; accordingly, in the first embodiment, the swelling ratio of the connecting terminal T substantially corresponds to the swelling ratio of the elastic body 90. For example, in a configuration (hereinafter, referred to as a "comparative example") in which the swelling ratio of the connecting terminals T is smaller than the swelling ratio of the adhesive agent B, when the connecting terminals T and the adhesive agent B absorbs moisture, the adhesive agent B swells more than the connecting terminals T and the diaphragm 42 and the base portion 70 of the wiring substrate 46 are moved away from each other; accordingly, the pressing force from either one of the diaphragm 42 and the connecting terminal T to the other one of the diaphragm 42 and the connecting terminal T becomes smaller. Accordingly, a problem in that the electrical connection between the wires 72 and the wires 82 becomes insufficient occurs in the comparative example. Accordingly, in the first embodiment, the swelling ratio of each connecting terminal T is set larger than the swelling ratio of the adhesive agent B. In other words, the increase in the volume due to absorption of moisture in each connecting terminal T is larger than that in the adhesive agent B. With the above configuration, when the connecting terminal T and the adhesive agent B absorbs moisture, the pressing force from either one of the diaphragm 42 and the connecting terminals T to the other one of the diaphragm 42 and the connecting terminals T increases. Accordingly, compared with the comparative example, the first embodiment can obtain sufficient electric connections between the wires 72 and the wires 82.

Second Embodiment

A description of a second embodiment will be given. Note that in the following examples, elements having functions similar to those of the first embodiment will be denoted by applying the reference numerals used in the description of the first embodiment, and detailed description of the elements will be omitted appropriately.

Figure 7:
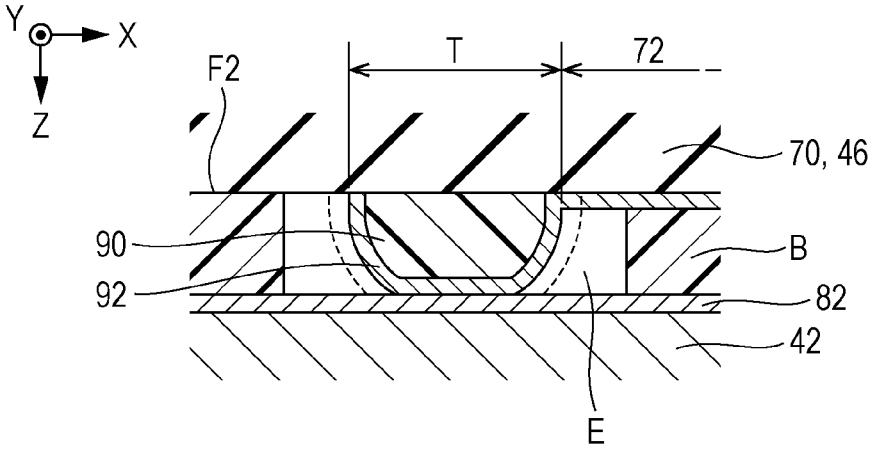
FIG. 7 is a cross-sectional view of a diaphragm and a wiring substrate according to a second embodiment.

FIG. 7 is a cross-sectional view of the diaphragm 42 and the wiring substrate 46 according to the second embodiment. As illustrated as an example in FIG. 7, similar to the first embodiment, the diaphragm 42 and the base portion 70 of the wiring substrate 46 are adhered to each other with the adhesive agent B in the second embodiment as well. However, while in the first embodiment, each connecting terminal T is in contact with the adhesive agent B, in the second embodiment, a space E is formed between each connecting terminal T and the adhesive agent B. In other words, the adhesive agent B is not in contact with the connecting terminals T.

An effect similar to the first embodiment can be provided in the second embodiment as well. In the second embodiment, since spaces E are formed between the connecting terminals T and the adhesive agent B, when the connecting terminals T swell, contact surfaces between the connecting terminals T and the wires 72 increase. Specifically, the contact surface increases in the XY plane as illustrated with a broken line in FIG. 7. Accordingly, electric connections between the wires 72 and the wires 82 are obtained sufficiently. On the other hand, the configuration of the first embodiment in which the connecting terminals T and the adhesive agent B are in contact with each other has an advantage in that the diaphragm 42 and the base portion 70 are firmly adhered to each other.

Third Embodiment

Figure 8:
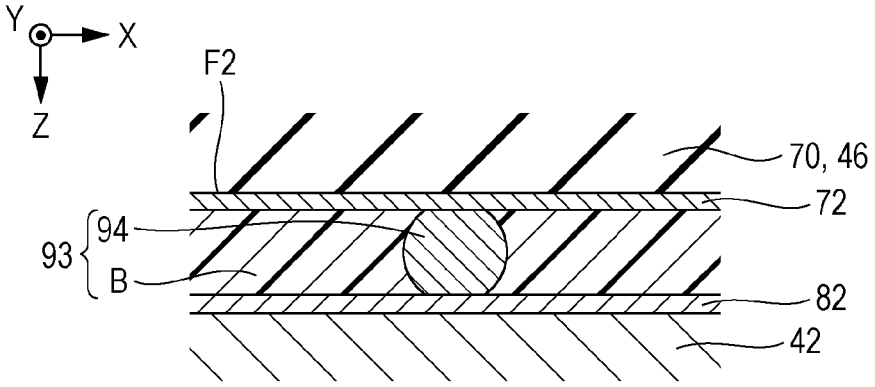
FIG. 8 is a cross-sectional view of a diaphragm and a wiring substrate according to a third embodiment.

FIG. 8 is a cross-sectional view of the diaphragm 42 and the wiring substrate 46 according to a third embodiment. In the third embodiment, the connecting terminals T are omitted. As illustrated as an example in FIG. 8, the wires 72 of the third embodiment is formed to overlap the wires 82 in plan view. In the third embodiment, an anisotropic conductive film 93 containing conductive particles 94 is used to adhere the base portion 70 and the diaphragm 42 to each other. In other words, the anisotropic conductive film 93 is interposed between the base portion 70 and the diaphragm 42. The anisotropic conductive film 93 is a film in which conductive particles 94 formed of metal, for example, are dispersed in the adhesive agent B. The adhesive agent B is an insulating resin material, for example. The conductive particles 94 are configured to elastically deform. A swelling ratio of the conductive particles 94 is larger than the swelling ratio of the adhesive agent B.

Figure 9:
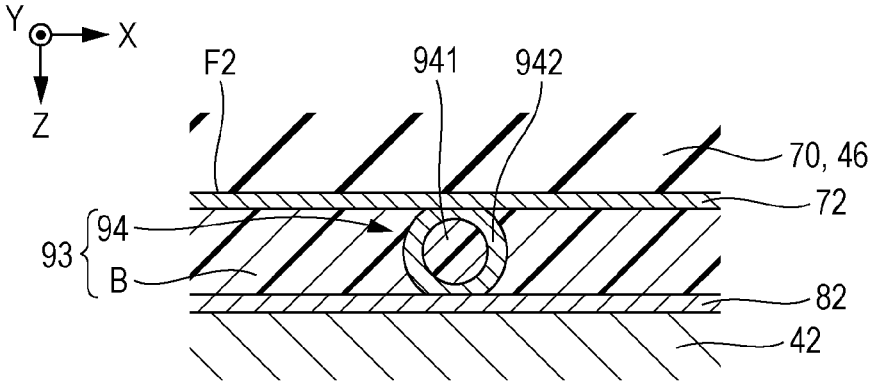
FIG. 9 is a cross-sectional view of a conductive particle according to another aspect of the third embodiment.

While the anisotropic conductive film 93 is interposed between the wires 72 and the wires 82, the diaphragm 42 and the base portion 70 are adhered to each other with the anisotropic conductive film 93. When adhered, either one of the diaphragm 42 and the base portion 70 is pressed against the other one of the diaphragm 42 and the base portion 70. While the conductive particles 94 are interposed between the wires 72 and the wires 82, the diaphragm 42 and the base portion 70 are adhered to each other. Accordingly, the wires 72 and the wires 82 are electrically coupled to each other through the conductive particles 94. The conductive particles 94 of the third embodiment are formed between the diaphragm 42 and the base portion 70, electrically couple the wires 72 and the wires 82 to each other, and function as elastically deformable protrusions. Note that as illustrated as an example in FIG. 9, a particle in which an elastic body 941 formed of a resin material is coated with a conductive film 942 formed of metal or the like may be used as each of the conductive particles 94.

An effect similar to that of the first embodiment can be provided in the third embodiment as well. Since the conductive particles 94 included in the anisotropic conductive film 93 function as the protrusions, the third embodiment is advantageous in that a step of forming the protrusions will not be needed.

Modifications

Each of the embodiments described above as examples can be modified in various ways. Specific modification modes that can be applied to the embodiments described above will be described below as examples. Two or more optionally selected modes from the examples below can be merged as appropriate as long as they do not contradict each other.

Figure 10:
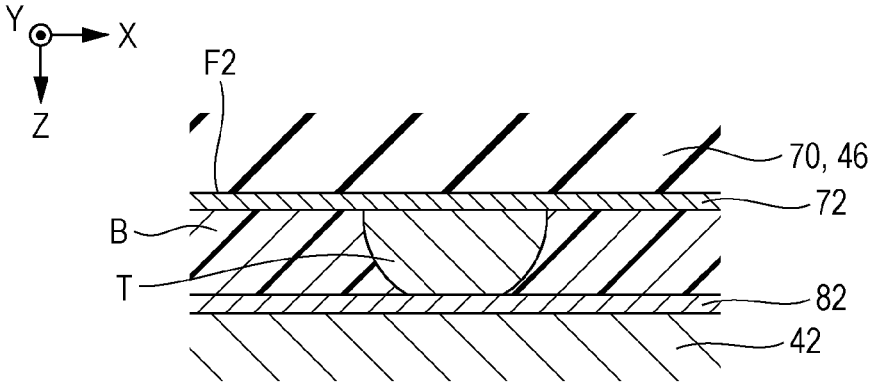
FIG. 10 is a cross-sectional view of a diaphragm and a wiring substrate according to a modification.

(1) In the first and second embodiments, the connecting terminal T is configured of the elastic body 90 and the conductive film 92; however, the configuration of the connecting terminal T is not limited to the example described above. For example, the connecting terminal T may be formed of a conductive elastic material. In such a configuration, as illustrated in FIG. 10, the connecting terminal T is formed on a surface of the wire 72. The connecting terminal T is formed for each wire 72.

(2) In the first and second embodiments, the connecting terminals T are formed on the base portion 70; however, the connecting terminals T may be formed on the diaphragm 42. In such a configuration, the conductive film 92 of each connecting terminal T is coupled to the corresponding wire 82, and a portion in the vicinity of the top of each connecting terminal T is in contact with a surface of the corresponding wire 72. As understood from the above description, as long as the connecting terminals T are formed between the diaphragm 42 and the base portion 70, the connecting terminals T may be formed on the base portion 70 or may be formed on the diaphragm 42.

(3) The drive elements that eject the liquid inside the pressure chambers C from the nozzles N are not limited to the piezoelectric elements 44 illustrated as an example in each of the embodiments. For example, heating elements that generate air bubbles inside the pressure chambers C through heating to change the pressure therein may be used as the drive elements. As understood from the examples described above, the drive elements are expressed comprehensively as elements that eject the liquid in the pressure chambers C through the nozzles N, and the operation system and the specific configuration of the drive elements do not need to be stated in particular.

(4) While in the embodiments described above, the serial type liquid ejecting apparatus 100 in which the transport body 242 in which the liquid ejecting head 26 is mounted is reciprocated has been described as an example, a line type liquid ejecting apparatus in which a plurality of nozzles are distributed across the entire width of the medium 12 can also be applied to the present disclosure.

(5) The liquid ejecting apparatus 100 described as an example in the embodiments described above may be employed in various apparatuses other than an apparatus dedicated to printing, such as a facsimile machine and a copier. Note that the application of the liquid ejecting apparatus of the present disclosure is not limited to printing. For example, a liquid ejecting apparatus that ejects a coloring material solution is used as a manufacturing apparatus that forms a color filter of a display device such as a liquid crystal display panel. Furthermore, a liquid ejecting apparatus that ejects a conductive material solution is used as a manufacturing apparatus that forms wiring and electrodes of a wiring substrate. Furthermore, a liquid ejecting apparatus that ejects a solution of an organic matter related to a living body is used, for example, as a manufacturing apparatus that manufactures a biochip.

What is claimed is:

1. A liquid ejecting head comprising:

a first substrate in which a drive element that ejects a liquid from a nozzle, and a first wire electrically coupled to the drive element are formed;

a second substrate in which an opposing surface that opposes the first substrate is adhered to the first substrate with an adhesive agent, a second wire being formed in the second substrate; and a protrusion configured to elastically deform, the protrusion being formed between the first substrate and the second substrate and electrically coupling the first wire and the second wire to each other, wherein a swelling ratio of the protrusion is larger than a swelling ratio of the adhesive agent.

2. The liquid ejecting head according to claim 1, wherein the protrusion is in contact with the adhesive agent.

3. The liquid ejecting head according to claim 1, wherein a space is formed between the protrusion and the adhesive agent.

4. The liquid ejecting head according to claim 1, further comprising:

an anisotropic conductive film interposed between the first substrate and the second substrate, wherein the anisotropic conductive film includes the adhesive agent and a conductive particle, and the protrusion is the conductive particle.

5. A liquid ejecting apparatus comprising:

the liquid ejecting head according to claim 1.

* * * * *